US008238776B2

(12) United States Patent
Kim

(10) Patent No.: US 8,238,776 B2
(45) Date of Patent: Aug. 7, 2012

(54) IMAGE FORMING DEVICE TO PERFORM AUTO COLOR REGISTRATION AND METHOD THEREOF

(75) Inventor: Gun-ho Kim, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 261 days.

(21) Appl. No.: 11/968,796

(22) Filed: Jan. 3, 2008

(65) Prior Publication Data

US 2008/0166147 A1 Jul. 10, 2008

(30) Foreign Application Priority Data

Jan. 5, 2007 (KR) ..... 10-2007-0001647

(51) Int. Cl.
*G03G 15/00* (2006.01)
*G03G 15/01* (2006.01)

(52) U.S. Cl. ..... 399/72; 399/301

(58) Field of Classification Search ..... 399/49, 399/72, 301
See application file for complete search history.

(56) References Cited

U.S. PATENT DOCUMENTS 6,243,542 B1 * 6/2001 Fujimoto et al. ..... 399/49
7,133,056 B2 * 11/2006 Tanaka et al. ..... 347/116
2006/0177247 A1 * 8/2006 Tanaka et al. ..... 399/301

FOREIGN PATENT DOCUMENTS

CN 1207629 2/1999
CN 1527151 9/2004

OTHER PUBLICATIONS

Chinese Office Action issued Nov. 6, 2009 in CN Application No. 2008100016305.

* cited by examiner

*Primary Examiner* — David Gray
*Assistant Examiner* — Gregory H Curran
(74) *Attorney, Agent, or Firm* — Stanzione & Kim, LLP

(57) ABSTRACT

An image forming device to perform an auto color registration. The image forming device includes a print unit capable of performing a print job in accordance with a plurality of print modes, a color registration processing unit to perform an auto color registration (ACR), a storage unit to store color registration conditions for the respective print modes, and a control unit to control the color registration processing unit to perform the ACR in accordance with the color registration condition corresponding to the present print mode of the print unit. The color registration condition may be at least one of a color registration execution period, a color registration execution time, and a color registration pattern. According to the image forming device, the proper ACR can be performed by print modes.

12 Claims, 4 Drawing Sheets

200

| COLOR REGISTRATION OPTION | |
|---|---|
| OPERATION MODE | TONER SAVE MODE |
| AUTO EXECUTION PERIOD | 500 SHEETS |
| EXECUTION TIME | FIVE SECONDS |
| REGISTRATION PATTERN | SLENDER-LINE PATTERN |

IMAGE FORMING DEVICE TO PERFORM AUTO COLOR REGISTRATION AND METHOD THEREOF

CROSS-REFERENCE TO RELATED APPLICATIONS

This application claims priority under 35 U.S.C. §119 (a) of Korean Patent Application No. 10-2007-001647, filed on Jan. 5, 2007, in the Korean Intellectual Property Office, the disclosure of which is incorporated herein by reference in its entirety.

BACKGROUND OF THE INVENTION

1. Field of the Invention

The present general inventive concept relates to an image forming device to perform an auto color registration and a method thereof. More particularly, the present general inventive concept relates to an image forming device to perform an auto color registration according to different conditions of different print modes.

2. Description of the Related Art

With the development of electronic technology, peripheral devices such as a printer, a scanner, and so forth, in addition to a computer, have been actively spread. Particularly, as manufacturers strive to be first in developing printers, laser printers, which have remarkable effects in printing quality, printing speed, noise occurrence, and so forth, in comparison to the existing dot printers and inkjet printers, have been increasingly used. A laser printer performs a printing operation in a manner that it gets toner on an organic photoconductive unit (OPC), transfers the toner put on the OPC to a printing paper, and fuses the toner on the printing paper with high heat and pressure.

The laser printer prints an image through processes of charging, writing, developing, transferring, fusing, and so forth. The charging is a process of forming negative charge on the OPC surface through Corona discharge by applying a high voltage (of about 7000V) to a discharger. The writing is a process of forming a latent image by extinguishing the negative charge formed on the OPC surface in the form of a letter through scanning of laser beams on the OPC surface. The developing is a process of making toner particles having the negative charge stick to the latent image portion of the OPC surface. The transferring is a process of pulling the negatively charged toner particles formed on the OPC surface in a direction of a printing paper by forming a negative charge on a rear surface of the paper through the applying of a specified transfer voltage to a transfer machine when the paper passes between the OPC and the transfer machine. The fusing is a process of completely fusing the toner particles on the paper by applying proper heat and pressure to the toner formed on the paper.

Recently, uses of color laser printers have been widespread. The color laser printer generally represents a color image by using toners of four colors, CMYK. In order to print a clear image, the color laser printer generally performs the printing work for each of the color toners by using four OPCs. Also, in order to locate the respective color toners at correct positions, the transferring process is performed in two stages by using an intermediate transfer belt (ITB).

On the other hand, in order to express the colors, the toners should be accurately superimposed and transferred onto the same position by using a plurality of OPCs and transfer machines. However, as the number of prints is increased, the toner transfer positions may be mismatched due to operation errors among the transfer machines. That is, the respective transfer machines cannot transfer the toner in the same position, and this causes the edge portion of the image to be blurred.

Conventionally, in order to solve the above-described problems, an auto color registration function has been introduced. This auto color registration function is performed at predetermined intervals. Typically, the auto color registration is to match the transfer positions in a manner that if transferred images of the respective transfer machines are mismatched by X dots when N printing papers are printed, the transfer positions are adjusted by X dots whenever N printing papers are printed.

However, whenever the color registration work is performed, a large amount of toner is consumed, and thus the amount of waste toner is increased. Even if a user sets the present mode to a toner save mode for saving toner, the color registration work is performed with a large amount of toner consumed, and this is against the user's intention to save the toner.

In addition, since the user cannot use the image forming device while the color registration is performed, the frequent color registration works may cause the user inconvenience. Recently, as image forming devices have been increasingly used at home, personal users are taking serious considerations of saving of toner and increasing convenience in use. However, the conventional image forming device having the auto color registration function does not meet the users' demands.

SUMMARY OF THE INVENTION

The present general inventive concept provides an image forming device to perform an auto color registration and a method thereof, which can achieve an efficient use of toner and provide users' convenience by performing an auto color registration using color registration conditions differently set according to print modes.

Additional aspects and utilities of the present general inventive concept will be set forth in part in the description which follows and, in part, will be obvious from the description, or may be learned by practice of the general inventive concept.

The foregoing and other aspects and utilities of the present general inventive concept may be achieved by providing a color registration method for an image forming device which can perform a print job in accordance with a plurality of print modes and in which color registration conditions corresponding to the respective print modes are pre-stored, the color registration method including confirming the present print mode of the image forming device; and performing an auto color registration (ACR) in accordance with the color registration condition corresponding to the present print-mode.

The plurality of print modes may include a low-quality print mode and a high-quality print mode.

The color registration condition may be set in accordance with the present print mode of the low-quality print mode and the high-quality print mode.

The operation of performing the ACR may include judging whether the color registration execution period corresponding to the present print mode has arrived.

The color registration condition may include at least one of a color registration execution period, a color registration execution time, and a color registration pattern.

The color registration condition may be changeable.

The color registration method according to embodiments of the present general inventive concept may further include displaying the present color registration condition to set the color registration condition.

The foregoing and other aspects and utilities of the present general inventive concept may also be achieved by providing an image forming device including: a print unit capable of performing a print job in accordance with a plurality of print modes; a color registration processing unit to perform an auto color registration (ACR); a storage unit to store color registration conditions corresponding to the respective print modes; and a control unit to control the color registration processing unit to perform the ACR in accordance with the color registration condition corresponding to the present print mode of the print unit.

The print unit may be capable of operating in one of a low-quality print mode and a high-quality print mode.

The control unit may control the color registration processing unit in which the color registration condition is applied under the print mode that supports the low-quality print and the high-quality print mode.

The control unit may judge whether a color registration execution period corresponding to the present print mode has arrived, and if it is judged that the color registration execution period has been arrived, control the color registration processing unit to start the ARC.

The color registration condition may include at least one of a color registration execution period, a color registration execution time, and a color registration pattern.

The color registration condition may be changeable.

The image forming device according to embodiments of the present general inventive concept may further include a user interface unit to display the current color registration condition to set the color registration condition, wherein the control unit updates the color registration condition set through the user interface unit in the storage unit.

BRIEF DESCRIPTION OF THE DRAWINGS

These and/or other aspects and utilities of the present general inventive concept will become apparent and more readily appreciated from the following description of the exemplary embodiments, taken in conjunction with the accompanying drawings of which.

Throughout the drawings, the same drawing reference numerals will be understood to refer to the same elements, features and/or structures.

DETAILED DESCRIPTION OF THE PREFERRED EMBODIMENTS

Figure 1:
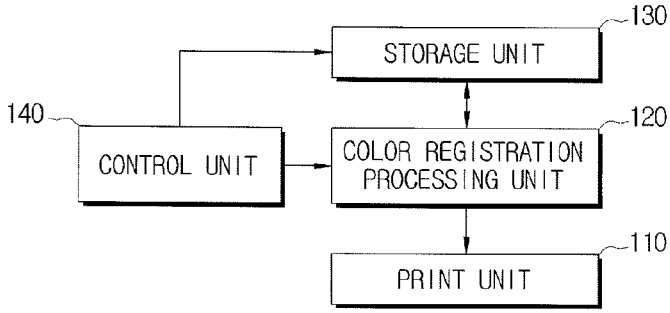
FIG. 1 is a block diagram illustrating the construction of an image forming device according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a block diagram illustrating the construction of an image forming device according to an exemplary embodiment of the present general inventive concept.

Referring to FIG. 1, the image forming device 100 according to this exemplary embodiment comprises a print unit 110, a color registration processing unit 120, a storage unit 130, and a control unit 140.

The print unit 110 performs a print job in accordance with diverse types of print modes. Specifically, the print unit 110 controls the resolution of an image and prints the image in accordance with diverse print modes such as a high-resolution mode, a normal mode, a low-resolution mode, a toner save mode, and so forth. Such print mode is also referred to as an operation mode.

The color registration processing unit 120 performs an auto color registration (ACR). Details of the ACR will be described later.

The storage unit 130 stores the color registration condition set for each print mode. The color registration condition may be at least one of a color registration execution period, a color registration execution time, and a color registration pattern.

The color registration execution period refers to a period in which the color registration is performed. It is preferable that the color registration is frequently performed in a mode that requires a high resolution, and is less frequently performed in a toner save mode. That is, in a mode in which a low-quality print is performed (e.g., a low-resolution mode, a toner save mode, and so forth), an extended period is applied, while, in a mode in which a high-quality print is performed (e.g., a high-resolution mode, a normal mode, and so forth), a shortened period is applied.

The color registration execution time refers to a time required to perform the color registration work. That is, the color registration work is performed in a manner that as an image according to the registration pattern is formed several times, the degree of mismatch is checked, and the registration rate is determined accordingly, to perform the color registration. For example, as the forming of C, M, Y, and K images on an intermediate transfer belt is performed 5 to 50 times, the image registration rate is determined by checking the degree of mismatch.

In this case, if the number of times of forming the image according to the registration pattern is reduced, the color registration execution time itself may be shortened. In the same manner as the execution period, it is preferable that the color registration execution time is set to a long time (i.e., an extended time relative to the time in a normal mode) in a mode that requires a high resolution, while the color registration execution time is set to a short time (i.e., a shortened time relative to the time in a normal mode) in a toner save mode. For example, in the case of a high-resolution mode, the color registration execution time is set to a long time, i.e., the number of times of forming the image is set to a large number of times (e.g., 50 times), while in the case of a toner save mode, the color registration execution time is set to a short time, i.e., the number of times of forming the image is set to a small number of times (e.g., 5~10 times). The number of times of forming the image may differ by embodiments.

The registration pattern refers to a pattern that is used for the color registration work. This pattern may be formed in diverse forms. The registration pattern may also be set on the basis of the amount of toner consumption. That is, in the high-resolution mode, a pattern whereby the registration error rate can be best detected is set irrespective of the amount of toner consumption, while in the toner save mode, a pattern that has a small amount of toner consumption is set even if the detection of the registration error rate is relatively difficult.

As mentioned above, the storage unit 130 may store information on how often the color registration work is performed, how long the color registration work is performed (length of time), and which pattern is used to perform the color registration work.

The control unit 140 confirms the present print mode of the print unit 110, and controls the color registration processing unit 120 to perform the auto color registration in accordance with the color registration condition corresponding to the confirmed print mode.

That is, if the present print mode is the toner save mode, the color registration processing unit 120 performs the color registration work by using the execution period, the execution time, and the registration pattern set for the toner save mode. The color registration work will now be described in detail with reference to FIG. 2.

Figure 2:
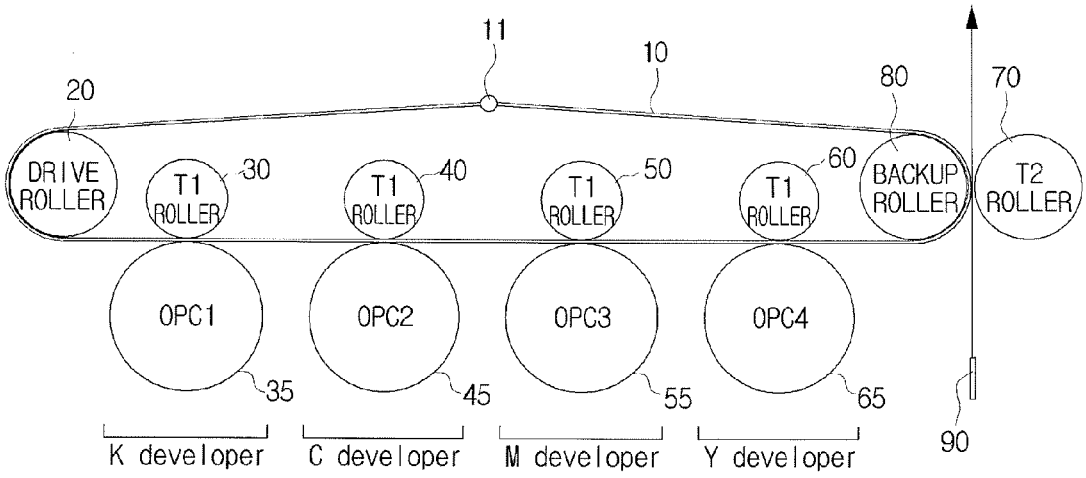
FIG. 2 is a schematic view illustrating the construction of a print unit applicable to the image forming device of FIG. 1.

FIG. 2 is a schematic view illustrating the construction of a print unit 110 applicable to the image forming device, which performs a two-stage transfer work by using an intermediate transfer belt.

Referring to FIG. 2, the print unit 110 comprises an intermediate transfer belt 10, a drive roller 20, four T1 transfer rollers 30, 40, 50 and 60, four organic photoconductor cartridges (OPCs) 35, 45, 55 and 65, a T2 transfer roller 70, and a T2 transfer roller backup roller 80.

To a latent image portion formed on the organic photoconductor cartridges (OPCs) 35 to 65, toners corresponding to K (black), C (Cyan), M (Magenta), and Y (Yellow) are attached through a development process. In FIG. 2, developers are not illustrated.

The T1 transfer rollers 30 to 60 that correspond to the respective OPCs 35 to 65 are formed along the intermediate transfer belt 10. Accordingly, the toners attached to the surfaces of the respective OPCs 35 to 65 are first transferred to the surface of the intermediate transfer belt 10 by the respective T1 transfer rollers 30 to 60. In this case, by recognizing a position mark 11 located on the intermediate transfer belt 10 and synchronizing the operation of the respective OPCs 35 to 65 with the operation of the T1 transfer rollers 30 to 60, one color image is represented. Accordingly, the image formed on the intermediate transfer belt 10 is transferred to a paper 90 through a second transfer process between the T2 transfer roller 70 and the T2 transfer roller backup roller 80. Meanwhile, the drive roller 20 serves to move the intermediate transfer belt 10 at a proper speed.

In the case of constructing the print unit 110 as illustrated in FIG. 2, the color registration processing unit 120 forms a color registration pattern on the intermediate transfer belt 10 by using the respective transfer rollers 30 to 60 and the respective OPCs 35 to 65 when the registration period corresponding to the present print mode has arrived. Then, the color registration processing unit 120 matches the transfer timing of the respective transfer rollers 30 to 60 in accordance with the degree of mismatch among the formed color registration patterns. For example, if it is judged that the C-toner image is delayed and thus is formed later than an exact position, the color registration processing unit 120 speeds up the drive timing of the second T1 roller 40. By contrast, if it is judged that the C-toner image is formed earlier than the exact position, the color registration processing unit 120 delays the drive timing of the second T1 roller 40. As described above, the color registration processing unit 120 controls the print unit 110 to form the set color registration pattern for a predetermined time whenever the registration period has arrived, and performs the color registration work by comparing the formed color registration patterns.

Figure 3:
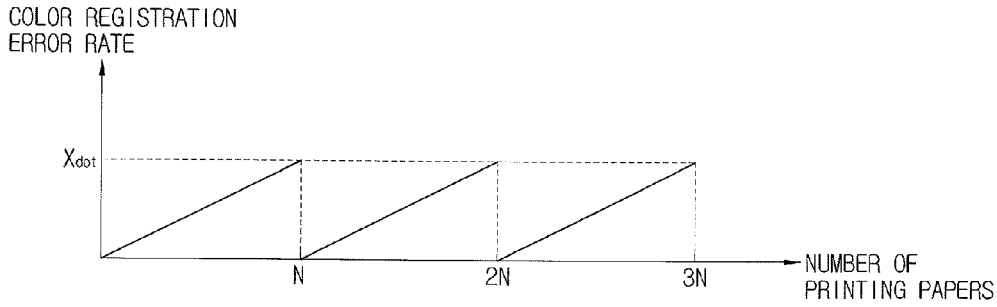
FIGS. 3 and 4 are views explaining a difference in registration period between print modes.
Figure 4:
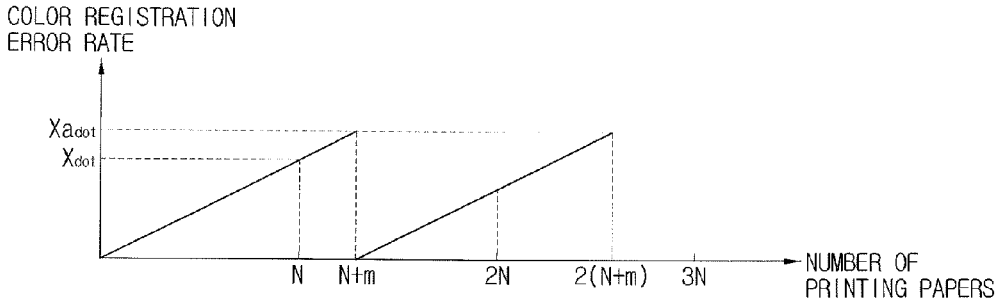

FIGS. 3 and 4 are views explaining a difference in registration period between print modes.

First, FIG. 3 illustrates the color registration execution period in a normal mode. Referring to FIG. 3, whenever N printing papers are printed, the color registration is mismatched by about X dots in the normal mode, and thus by performing the color registration whenever the printing of N printing papers is completed, the color registration error rate is lowered to "0."

By contrast, FIG. 4 illustrates the color registration execution period in a toner save mode. Referring to FIG. 4, by performing a color registration by about Xa dots whenever N+m printing papers are printed, the color registration error rate is lowered to "0."

As described above, in the toner save mode, by applying an extended color registration execution period, the number of color registration works is reduced, and this results in the reduction of the toner consumption.

In FIGS. 3 and 4, it is exemplified that the normal mode and the toner save mode are compared with each other. However, in the case where the image forming device has diverse print modes, different conditions may be set by print modes. For example, in the case where a high-resolution mode is supported, the number of prints may be set to N-b so as to further shorten the execution period.

Meanwhile, in FIGS. 3 and 4, only the execution period is illustrated. However, the execution time may also differ depending on the print modes. That is, if it is assumed that each color registration work is performed for Y seconds in the normal mode, the color registration work may be performed only for Y-b seconds in the case of the toner save mode. Specifically, in FIG. 2, if the color registration processing unit 120 performs the forming and comparing of registration patterns 10 times for Y seconds, it may be set that the color registration processing unit performs the comparison work only 5~6 times for Y-b seconds in the toner save mode. In this case, the color registration error rate may not be lowered to "0" completely, but the toner is saved and other work can be done for the remaining time.

In addition, the color registration pattern may differ by print modes. That is, if a color registration mode corresponding to a large amount of toner consumption is used in the normal mode, a color registration pattern having a relatively small amount of toner consumption, such as a horizontal-line pattern, a vertical-line pattern, a slanting-line pattern, and so forth, may be used in the toner save mode.

Figure 5:
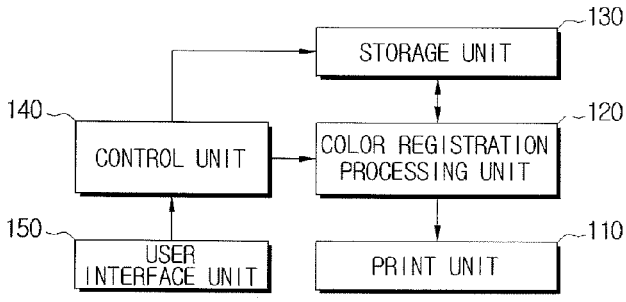
FIG. 5 is a block diagram illustrating the construction of an image forming device according to another exemplary embodiment of the present general inventive concept.

FIG. 5 is a block diagram illustrating the construction of an image forming device according to another exemplary embodiment of the present general inventive concept.

Referring to FIG. 5, the image forming device according to this exemplary embodiment comprises a print unit 110, a color registration processing unit 120, a storage unit 130, a control unit 140, and a user interface unit 150.

The user interface unit 150 provides a user interface window to set color registration conditions by print modes. Specifically, the user interface unit 150 can provide a user interface window through a display unit (not illustrated) such as a touch pad, a touch screen, an LCD panel, and so forth.

The control unit 140 updates and stores the color registration conditions set through the user interface unit 150 in the storage unit 130. The color registration processing unit 120 performs the auto color registration work by using the updated color registration conditions.

Figures 6, 7:
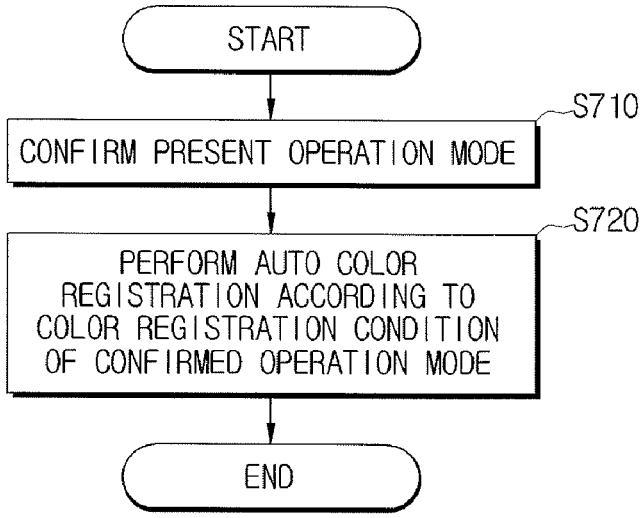
FIG. 6 is a view explaining a process of setting a color registration condition in an image forming device of FIG. 5.
FIG. 7 is a flowchart illustrating a color registration method according to an embodiment of the present general inventive concept.

On the other hand, the user interface unit may be implemented in a form as illustrated in FIG. 6.

Referring to FIG. 6, a user can set an execution period to 500 sheets, an execution time to 5 seconds, and a registration pattern to a slender-line pattern, respectively, with respect to a toner save mode, through the user interface window 200. In addition to the toner save mode, the user can directly set the color registration conditions even with respect to a high-resolution mode and a normal mode. For example, with respect to the high-resolution mode, the user can set the execution period to 100 sheets, the execution time to 10 seconds, and the registration pattern to a bold-line pattern, respectively. In addition, with respect to the normal mode, the user can set the execution period to 300 sheets, the execution time to 8 seconds, and the registration pattern to a middle-line pattern. In addition, with respect to a low-resolution mode, the user may set the same values as the toner save mode or the values desired by the user.

FIG. 7 is a flowchart illustrating a color registration method according to an embodiment of the present general inventive concept.

Referring to FIG. 7, the present print mode of the image forming device is first confirmed in operation S710. The print modes include a high-resolution mode, a normal mode, a toner save mode, and so forth. The print modes may further include a low-resolution mode and a photo print mode, or may include only the normal mode and the toner save mode.

If the present print mode is confirmed, the auto color registration is performed in accordance with the color registration condition for the confirmed print mode in operation S720.

Figure 8:
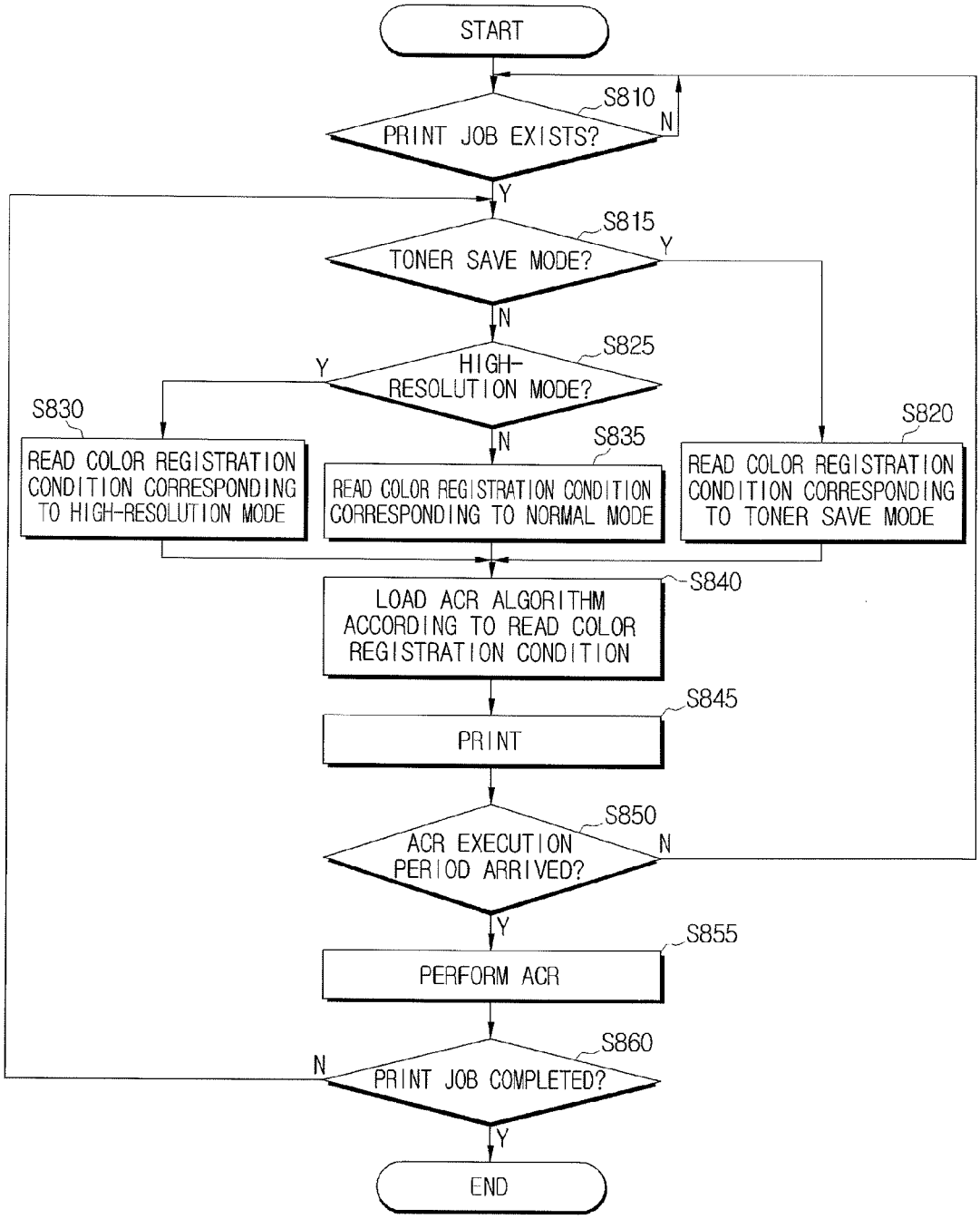
FIG. 8 is a flowchart illustrating in more detail the color registration method of FIG. 7.

FIG. 8 is a flowchart illustrating in more detail the color registration method that is performed by the image forming device that supports the high-resolution mode, the general mode, and the toner save mode.

Referring to FIG. 8, if a print job is received in operation S810, it is confirmed whether the present print mode is the toner save mode in operation S815. If the present print mode is the toner save mode as a result of confirmation, the color registration condition that corresponds to the toner save mode is read in operation S820.

By contrast, if the present print mode is not the toner save mode, it is confirmed whether the present print mode is the high-resolution mode in operation S825, and the color registration condition that corresponds to the high-resolution mode is read in operation S830. Otherwise, the color registration condition that corresponds to the normal mode is read in operation S835.

Then, an auto color registration (ACR) algorithm is loaded according to the read color registration condition in operation S840, and the printing of one page is performed in operation S845.

When the printing of one page is completed, it is judged whether the execution period set on the read color registration condition has arrived in operation S850. If the ACR execution period has not arrived, the printing of the next page is performed. In this case, it is checked whether the print mode for the next page is changed, and if the print mode for the next page is changed, the ACR algorithm for the changed print mode is loaded, and the next page is printed with the corresponding ACR algorithm applied thereto in operations S815 to S845.

By contrast, if the ACR execution period has arrived, the color registration work is executed in operation S855.

Thereafter, if the color registration work is completed, it is judged whether the print job is completed in operation S860. That is, it is judged whether the next page to be printed exists. If the print job is not completed, it is checked again whether the print mode is changed, and then the printing of the next page is performed accordingly in operations S815 to S855.

In order to describe the color registration method in more detail, it is assumed that the ACR algorithm for the toner save mode is loaded, the execution period is set to 500 sheets, and the number of sheets accumulated from the previous ACR execution time to the present time is 490. In this case, if the print job for a document composed of 30 sheets starts, it is confirmed whether 500 sheets have been printed by confirming the accumulated number of pages whenever each page is printed. Thus, if 10 pages have been printed, it is confirmed that the execution period has arrived. Accordingly, if the color registration work is ended after the color registration work is performed for about five seconds, the printing is performed again, starting from the $11^{th}$ page.

According to the image forming devices according to embodiments of the present general inventive concept, the auto color registration can be performed in accordance with the condition suitable for the present print mode.

While the print mode is classified into the high-resolution mode, general mode, and toner save mode in the embodiment of FIG. 8, alternatively, the print mode may be classified into a high-quality print mode and low-quality print mode.

As described above, according to the image forming devices according to embodiments of the present general inventive concept, the auto color registration is performed by applying the condition suitable for the present print mode, and thus the amount of toner consumption can be efficiently adjusted with the user's convenience improved.

The present general inventive concept can also be embodied as computer-readable codes on a computer-readable recording medium. The computer-readable recording medium is any data storage device that can store data which can be thereafter read by a computer system. Examples of the computer-readable recording media include read-only memory (ROM), random-access memory (RAM), CD-ROMs, magnetic tapes, floppy disks, optical data storage devices, and carrier waves (such as data transmission through the Internet). The computer-readable recording medium can also be distributed over network-coupled computer systems so that the computer-readable code is stored and executed in a distributed fashion. Also, functional programs, codes, and code segments to accomplish the present general inventive concept can be easily construed by programmers skilled in the art to which the present general inventive concept pertains. The method illustrated in FIGS. 7-8 can be stored in the computer-recorded medium in a form of computer-readable codes to perform the method when the computer reads the computer-readable codes of the recording medium.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A color registration method for an image forming device which can perform a print job in accordance with a plurality of print modes and in which color registration conditions corresponding to the respective print modes are set differently and pre-stored, the color registration method comprising:

confirming a present print mode of the image forming device;

reading the color registration condition corresponding to the confirmed print mode; and performing an auto color registration (ACR) only on a transfer belt in accordance with the read color registration condition in order to save toner or get a high-quality image, wherein the color registration condition is at least one of a color registration execution period, a color registration execution time, and a color registration pattern when the print job is a color print job, wherein the color registration condition is separately set for each print mode in order to make a toner consumption different for each print mode, and wherein the print mode is a mode regarding performing the print job and the print mode comprises a plurality of modes according to a resolution of an image to be formed.

2. The color registration method of claim 1, wherein the plurality of print modes comprise a low-quality print mode and a high-quality print mode.

3. The color registration method of claim 2, wherein the color registration condition is set in accordance with the present print mode of the low-quality print mode and the high-quality print mode.

4. The color registration method of claim 3, wherein the operation of performing the ACR comprises:

judging whether the color registration execution period corresponding to the present print mode has arrived.

5. The color registration method of claim 1, wherein the color registration condition is changeable.

6. The color registration method of claim 5, further comprising:

displaying the present color registration condition to set the color registration condition.

7. An image forming device comprising:

a print unit capable of performing a print job in accordance with a plurality of print modes;

a color registration processing unit to perform an auto color registration (ACR);

a storage unit to store color registration conditions set differently according to the respective print modes; and a control unit to control the color registration processing unit to perform the ACR only on a transfer belt in accordance with the color registration condition corresponding to the present print mode of the print unit in order to save toner or get a high-quality image, wherein the color registration condition is at least one of a color registration execution period, a color registration execution time, and a color registration pattern when the print job is a color print job, wherein the color registration condition is separately set for each print mode in order to make a toner consumption different for each print mode, and wherein the print mode is mode regarding performing the print job and the print mode comprises a plurality of modes according to a resolution of an image to be formed.

8. The image forming device of claim 7, wherein the print unit is capable of operating in one of a low-quality print mode and a high-quality print mode.

9. The image forming device of claim 7, wherein the control unit controls the color registration processing unit in which the color registration condition is applied under the print mode that supports the low-quality print and the high-quality print mode.

10. The image forming device of claim 7, wherein the control unit judges whether a color registration execution period corresponding to the present print mode has arrived, and if it is judged that the color registration execution period has been arrived, controls the color registration processing unit to start the ACR.

11. The image forming device of claim 7, wherein the color registration condition is changeable.

12. The image forming device of claim 11, further comprising:

a user interface unit to display the current color registration condition to set the color registration condition, wherein the control unit updates the color registration condition set through the user interface unit in the storage unit.

* * * * *